US008170246B2

(12) United States Patent
Yoo et al.

(10) Patent No.: US 8,170,246 B2
(45) Date of Patent: May 1, 2012

(54) APPARATUS AND METHOD FOR REPRODUCING SURROUND WAVE FIELD USING WAVE FIELD SYNTHESIS

(75) Inventors: Jae-hyoun Yoo, Daejon (KR); Dae-Young Jang, Daejon (KR); Hwan Shim, Seoul (KR); Hyunjoo Chung, Seoul (KR); Jun-Seok Lim, Seoul (KR); Koeng-Mo Sung, Seoul (KR); Tae-Jin Lee, Daejon (KR); Kyeongok Kang, Daejon (KR); Jin-Woong Kim, Daejon (KR); Chieteuk Ahn, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 964 days.

(21) Appl. No.: 12/168,959

(22) Filed: Jul. 8, 2008

(65) Prior Publication Data

US 2009/0136048 A1 May 28, 2009

(30) Foreign Application Priority Data

Nov. 27, 2007 (KR) ..... 10-2007-0121672

(51) Int. Cl.
*H04R 5/02* (2006.01)

(52) U.S. Cl. ..... 381/310

(58) Field of Classification Search ..... 381/1, 17–19, 381/86, 302, 310
See application file for complete search history.

(56) References Cited

U.S. PATENT DOCUMENTS 5,742,689 A * 4/1998 Tucker et al. ..... 381/17
6,584,202 B1 * 6/2003 Montag et al. ..... 381/63
2004/0055447 A1 * 3/2004 Childs et al. ..... 84/615
2004/0223620 A1 * 11/2004 Horbach et al. ..... 381/59
2005/0175197 A1 * 8/2005 Melchior et al. ..... 381/310
2006/0098830 A1 * 5/2006 Roeder et al. ..... 381/310
2006/0109992 A1 * 5/2006 Roeder et al. ..... 381/310
2006/0280311 A1 * 12/2006 Beckinger et al. ..... 381/17

FOREIGN PATENT DOCUMENTS

JP 2006-507727 A 3/2006
JP 2007-208318 A 8/2007
KR 1020060019610 A 3/2006
KR 1020060052666 5/2006
KR 1020070079945 A 8/2007

OTHER PUBLICATIONS

Seungkwon Beack, et al; "Angle-Based Virtual Source Location Representation for Spatial Audio Coding", ETRI Journal, vol. 28, No. 2, Apr. 2006, pp. 219-222 (Exact date not given in journal paper).

* cited by examiner

*Primary Examiner* — Elvin G Enad
*Assistant Examiner* — Alexander Talpalatskiy
(74) *Attorney, Agent, or Firm* — Ladas & Parry LLP

(57) ABSTRACT

Provided are an apparatus and a method for reproducing a surround wave field using wave field synthesis. The apparatus includes an audio signal analyzer for analyzing a received multi-channel audio signal to check the number of audio signal channels, and extracting a sound source signal for each checked channel from the multi-channel audio signal; a wave field synthesis renderer for localizing the extracted sound source signal for each channel at a virtual sound image outside a narrow space using wave field synthesis so that the extracted sound source signal is suitable for the number of the checked audio signal channels; and an audio reproducer for reproducing the localized virtual sound source signal.

13 Claims, 10 Drawing Sheets

APPARATUS AND METHOD FOR REPRODUCING SURROUND WAVE FIELD USING WAVE FIELD SYNTHESIS

CROSS-REFERENCE(S) TO RELATED APPLICATIONS

The present invention claims priority of Korean Patent Application No. 10-2007-0121672, filed on Nov. 27, 2007, which is incorporated herein by reference.

BACKGROUND OF THE INVENTION

1. Field of the Invention

The present invention relates to an apparatus and a method for reproducing a surround wave field using wave field synthesis; and, more particularly, to an apparatus and a method for reproducing a surround wave field using wave field synthesis that can provide a constant sound image to a user, regardless of his position, for example, a vehicle riding position, and provide a wide listening space even in a limited space by localizing multi-channel audio signals at virtual sound images outside a narrow space to reproduce a surround wave field using particularly wave field synthesis (WFS) rendering, when reproducing the multi-channel audio signals through a loudspeaker array installed in the narrow space, for example, a vehicle space.

Though a vehicle space will be exemplified as a narrow space in the following embodiments, it should be noted that the present invention is not limited to the vehicle space.

This work was supported by the IT R&D program of MIC/IITA [2007-S-004-01, "Development of Glassless Single-User 3D Broadcasting Technologies"]

2. Description of Related Art

Audio reproduction methods extending from a typical stereo method to a method using a recent multi-channel audio format have been studied in various ways to improve a sound image localization function inside a vehicle.

Unbalance is generated from listener to listener due to a limited space of a vehicle even in these various methods. Since one listener is located close to a specific loudspeaker and another listener is located distant from the specific loudspeaker in a vehicle, the sound pressure of an audio signal can be differently delivered depending on each listener, and a time delay by distance occurs. That is, unbalance occurs due to different sound pressures or time delays depending on the positions of listeners inside the vehicle. The left and right balance of a sound pressure can be controlled to resolve this unbalance. However, the controlling of the left and right balance has an effect only one of passengers inside the vehicle and cannot resolve unbalance caused by time delay.

As a digital versatile disc (DVD) player is mounted in a vehicle recently, a reproduction signal changes from a stereo two-channel signal as in a compact disc (CD) into a multi-channel signal. Accordingly, an attempt to mount a plurality of loudspeakers inside the vehicle gradually increases.

Particularly, a center channel loudspeaker is most generally mounted. At this point, the loudspeaker installed in a position of a center fascia or a rearview mirror serves to form a center channel audio image to a listener. Also, a loudspeaker can be installed even in a backdoor of a vehicle to provide a better sound image to a listener sitting on a backseat.

FIG. 1 is an exemplary view of multi-channel loudspeakers installed in a conventional vehicle.

Multi-channel loudspeakers installed in the conventional vehicle are included in an audio reproduction system inside the vehicle. As illustrated in FIG. 1, the audio reproduction system installed inside the conventional vehicle reproduces audio signals using loudspeakers at a total of five positions, that is, a front left loudspeaker 101, a front right loudspeaker 102, a rear left loudspeaker 103, a rear right loudspeaker 104, and a sub woofer loudspeaker 105. At this point, the sub woofer loudspeaker 105 of the five loudspeakers serves to form a surrounding effect in an audio reproduction space non-directionally. Therefore, the sub woofer loudspeaker 105 has nothing to do with wave field reproduction.

The four loudspeakers 101 to 104 included in the audio reproduction system inside the vehicle are installed at the front left, front right, rear left, and rear right, respectively, so that the positions of physical sound images are fixed at the corresponding four positions.

Therefore, three-dimensional (3-D) audio reproduction technology is applied to the plurality of loudspeakers installed in the vehicle to reproduce a multi-channel audio signal. Multi-channel audio reproduction technology known up to now such as 5.1 channel surround or 7.1 channel surround, which is conventional 3-D audio reproduction technology provides a much better sound image than conventional stereo reproduction technology.

However, the conventional multi-channel audio reproduction technology provides better sound image only when a listener sits on the center of concentric circles along which the loudspeakers are arranged inside the vehicle. That is, the conventional multi-channel audio reproduction technology cannot provide an optimum sound image unless the listener is not positioned at the center of the concentric circles inside the vehicle. Meanwhile, a loudspeaker array can be provided to the front to reinforce a sound, but this method has nothing to do with a 3-D wave field reproduction.

In other words, conventional multi-channel audio reproduction technology is simple audio reproduction technology through a loudspeaker inside a vehicle and has a limitation of allowing a listener to feel a different sound image depending on the riding position of the listener due to a narrow listening space of a vehicle and the position of the loudspeaker to cause unbalance in audio reproduction, or not to provide a better sound image. Therefore, the conventional multi-channel audio reproduction technology has a limitation that a listener has a difficulty in overcoming a restriction of a narrow listening space of a vehicle.

SUMMARY OF THE INVENTION

An embodiment of the present invention is directed to overcoming a narrow listening space and unbalance in a sound image caused by different sound pressures and time delay depending on the position of a listener inside a vehicle.

Another embodiment of the present invention is directed to providing an apparatus and a method for reproducing a surround wave field using wave field synthesis that can provide a constant sound image to a user regardless of a position, for example, a vehicle riding position, and provide a wide listening space even in a limited space by localizing multi-channel audio signals at a virtual sound image outside a narrow space to reproduce a surround wave field using particularly wave field synthesis (WFS) rendering, when reproducing the multi-channel audio signals through a loudspeaker array installed in the narrow space, for example, a vehicle space.

The present invention is characterized in reproducing a surround wave field by localizing multi-channel audio signals at a virtual sound image outside a narrow space using particularly wave field synthesis (WFS) rendering, when reproducing the multi-channel audio signals through a loudspeaker array installed in the narrow space, for example, a vehicle space.

The objects of the present invention are not limited to the above-mentioned ones. Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, there is provided an apparatus for reproducing a surround wave field, the apparatus including: an audio signal analyzer for analyzing a received multi-channel audio signal to check the number of audio signal channels, and extracting a sound source signal for each checked channel from the multi-channel audio signal; a wave field synthesis renderer for localizing the extracted sound source signal for each channel at a virtual sound image outside a narrow space using wave field synthesis so that the extracted sound source signal is suitable for the number of the checked audio signal channels; and an audio reproducer for reproducing the localized virtual sound source signal.

In accordance with another aspect of the present invention, there is provided a method for reproducing a surround wave field, the method including: analyzing a received multi-channel audio signal to check the number of audio signal channels, and extracting a sound source signal for each checked channel from the multi-channel audio signal; localizing the extracted sound source signal for each channel at a virtual sound image outside a narrow space using wave field synthesis so that the extracted sound source signal is suitable for the number of the checked audio signal channels; and reproducing the localized virtual sound source signal.

DESCRIPTION OF SPECIFIC EMBODIMENTS

The overall description of the present invention will be made below on the first place.

In accordance with the present invention, a loudspeaker array is mounted in a vehicle and an audio signal is reproduced by applying a WFS rendering to a sound source reproduction. At this point, in order to provide a wider listening space image to a passenger of the vehicle using WFS, all sound sources to be reproduced are regarded as point sound sources and reproduced as plane waves through the loudspeaker array, so that a virtual sound image can be localized to a position distant away from the position of the physical loudspeaker. Therefore, a listener can feel as if the listener is positioned in a wider listening space such as a living room of a house and a concert hall even in a narrow listening space of the vehicle, and can experience a constant sound image even when the listener sits on any seat, so that the listener can stably appreciate sounds.

The objects, characteristics, and advantages of the present invention become apparent through the following description described with reference to the accompanying drawings, and accordingly, those skilled in the art would easily carry out the spirit of the present invention. Also, in the following description, well-known functions or constructions are not described in detail since they would obscure the invention in unnecessary detail. Hereinafter, a specific embodiment of the present invention will be described in detail with reference to the accompanying drawings.

Figure 1:
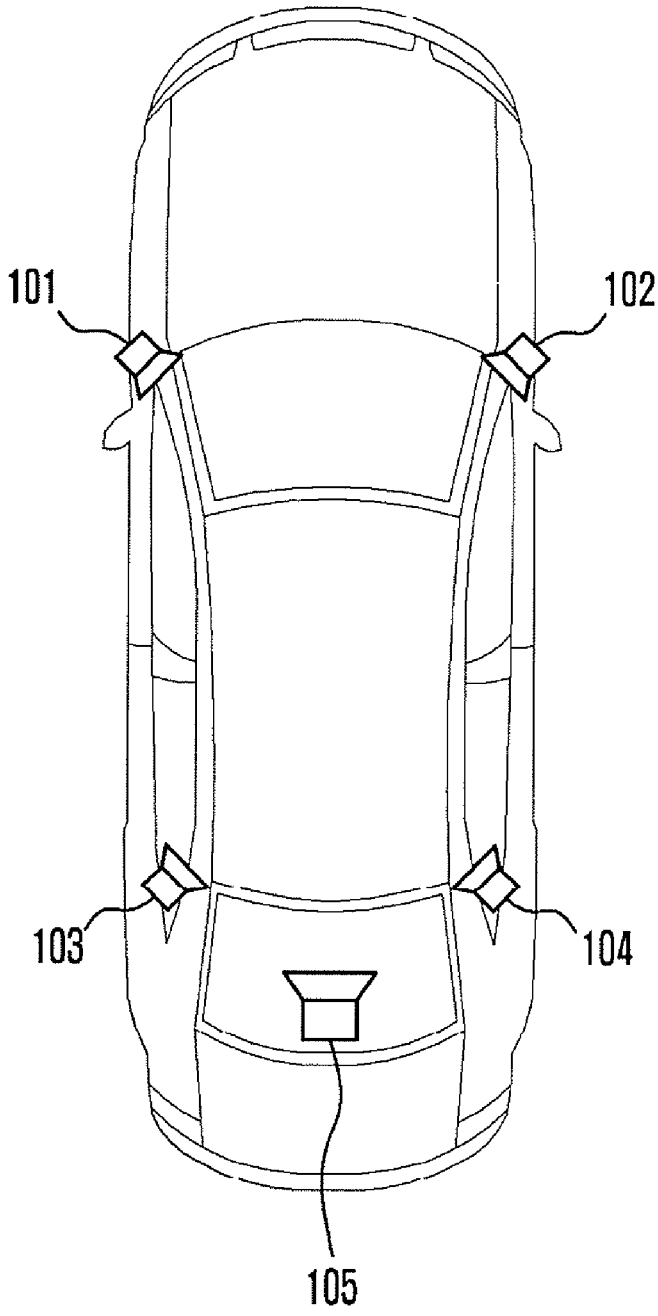
FIG. 1 is an exemplary view of multi-channel loudspeakers installed in a conventional vehicle.
Figure 2:
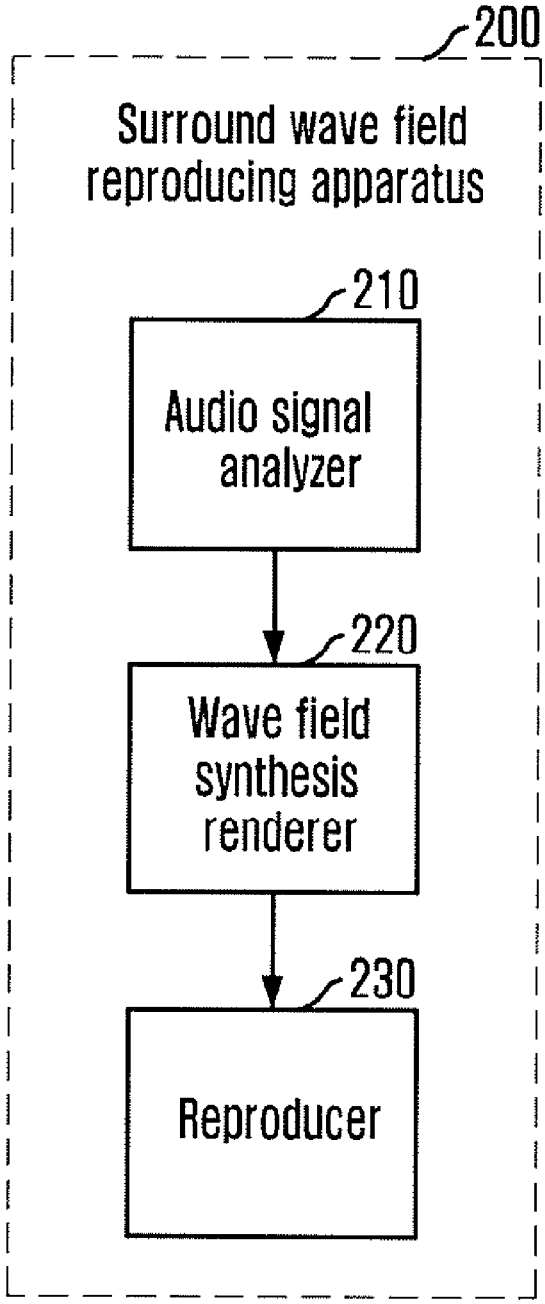
FIG. 2 is a structural view of a surround wave field reproducing apparatus for a vehicle using WFS in accordance with an embodiment of the present invention.

FIG. 2 is a structural view of a surround wave field reproducing apparatus for a vehicle using WFS in accordance with an embodiment of the present invention.

Referring to FIG. 2, the surround wave field reproducing apparatus for a vehicle 200 includes an audio signal analyzer 210, a wave field synthesis renderer 220, and a reproducer 130.

The surround wave field reproducing apparatus for a vehicle 200 reproduces sounds through a multi-channel loudspeaker array installed inside a vehicle. That is, the surround wave field reproducing apparatus for the vehicle 200 reproduces a surround wave field by localizing a multi-channel audio signal at a virtual sound image positioned in a space outside the vehicle using WFS. At this point, various multi-channel signals such as a stereo signal (two channels), a 5.1-channel signal, and a 7.1-channel signal are input to the surround wave field reproducing apparatus for the vehicle 200.

The audio signal analyzer 210 receives loudspeaker arrangement information, for example, arrangement-related information such as the position and interval of a loudspeaker arrangement, sound source position information, for example, position-related information such as the angle of a virtual sound source with respect to a listening position, and a multi-channel audio signal, that is, a sound source signal to be localized. Also, the audio signal analyzer 210 analyzes the sound source format of a received multi-channel audio signal to check the number of audio signal channels, and extracts a channel sound source signal for each checked audio signal channel from the received multi-channel audio signal.

Also, the wave field synthesis renderer 220 performs rendering on a multi-channel audio signal using WFS so that the signal is suitable for the number of the audio signal channels checked by the audio signal analyzer 210. That is, the wave field synthesis renderer 220 localizes a virtual sound source at a virtual sound image outside the vehicle so that the virtual sound source is suitable for the number of the checked audio signal channels. The number of virtual sound images changes depending on the number of the audio signal channels checked by the audio signal analyzer 210. For example, the wave field synthesis renderer 220 performs rendering on virtual sound sources of two directions, i.e., a front left direction and a front right direction using WFS when the sound sources of the multi-channel audio signal are two channels. Also, the wave field synthesis renderer 220 performs rendering on virtual sound sources of five directions in total, i.e., a front left direction, a front right direction, a central direction, a rear left direction, and a rear right direction using WFS when the sound sources of the multi-channel audio signal are 5.1 channels. At this point, the wave field synthesis renderer 220 compares the position of the loudspeaker with that of a listener to correct the height of the loudspeaker.

Also, the reproducer 130 reproduces the virtual sound sources on which rendering has been performed by the wave field synthesis renderer 220 through the multi-channel loudspeaker inside the vehicle.

Figure 3:
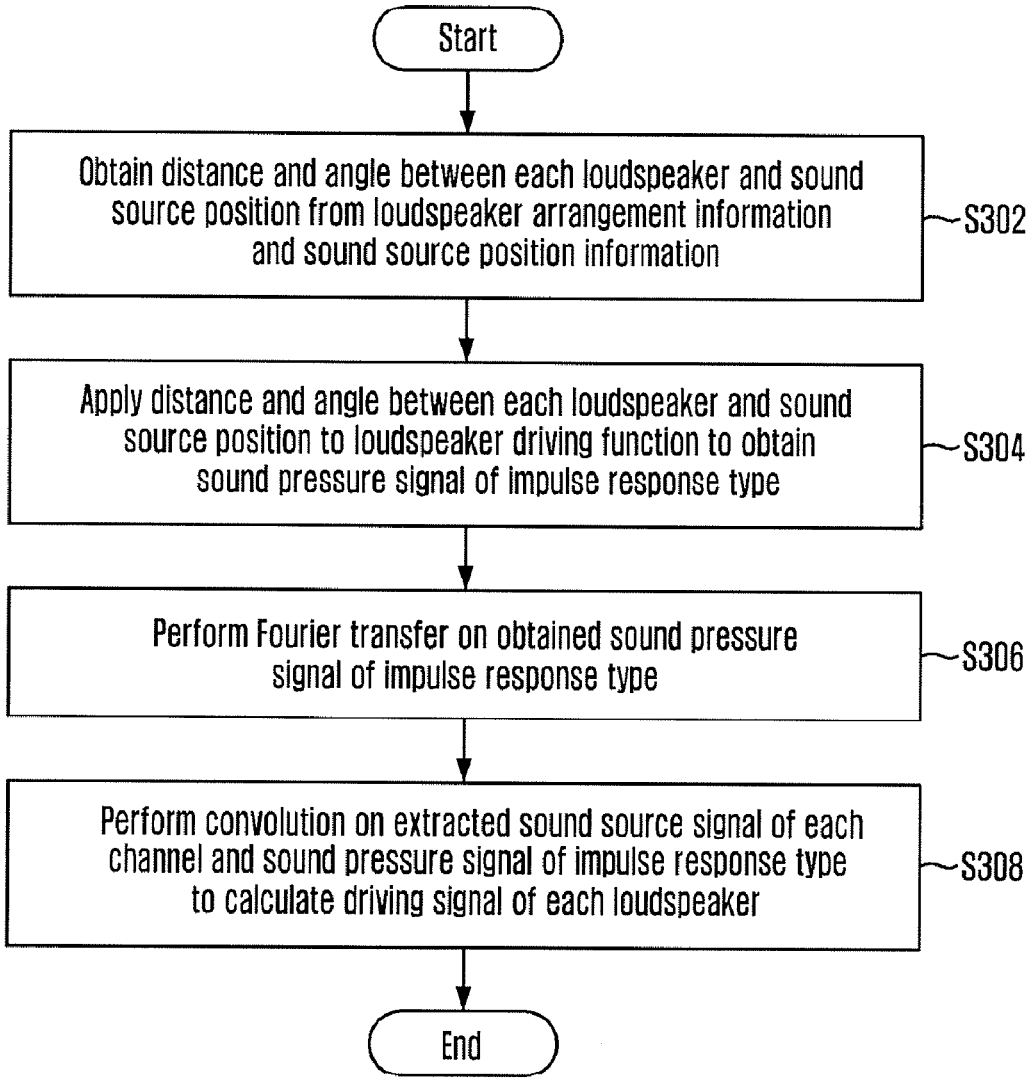
FIG. 3 is a flowchart illustrating a method for performing rendering using WFS in accordance with an embodiment of the present invention.

FIG. 3 is a flowchart illustrating a method for performing rendering using WFS in accordance with an embodiment of the present invention.

In operation S302, the wave field synthesis renderer 220 obtains a distance and an angle between each loudspeaker and a sound source position from arrangement information of the loudspeakers installed in the vehicle and sound source position information, such as position information of a virtual sound source to be reproduced.

In operation S304, the wave field synthesis renderer 220 applies the distance and the angle between each loudspeaker and the sound source position to a driving function to obtain a sound pressure signal of an impulse response type. That is, the wave field synthesis renderer 220 applies the distance and the angle between each loudspeaker and the sound source position to the following Equation 1, i.e., the driving function to calculate a sound pressure signal or sound that each loudspeaker should radiate. Also, the wave field synthesis renderer 220 calculates the sound pressure signal that each loudspeaker should radiate in the form of an impulse response for each loudspeaker with consideration of delay and gain.

$$Q(\vec{r_n}, \omega) = S(\omega)\sqrt{\frac{|z - z_1|}{|z - z_0|}}\,\frac{\cos(\theta_n)}{G_n(\theta_n, \omega)}\sqrt{\frac{jk}{2\pi}}\,\frac{e^{-jk|\vec{r_n}-\vec{r_m}|}}{\sqrt{|\vec{r_n}-\vec{r_m}|}} \qquad \text{Eq. 1}$$

where $Q(\vec{r}_n,\omega)$ is an audio signal driving function expressing radiation by an n-th loudspeaker of loudspeakers forming the loudspeaker array, $S(\omega)$ is a virtual sound source, $$\sqrt{\frac{|z - z_1|}{|z - z_0|}}$$

is weight for a size, $G_n(\theta_n,\omega)$ is orientation of a loudspeaker and a component giving weighting to a sound pressure, $\cos(\theta_n)$ is a ratio of a distance between a virtual sound source and an n-th loudspeaker to a vertical distance, $$\sqrt{\frac{jk}{2\pi}}$$

is high frequency amplification equalizing, $$e^{-jk|\vec{r_n}-\vec{r_m}|}$$

is a delivery time generated by a distance between a virtual sound source and the n-th loudspeaker. Also, since the loudspeakers form a linear arrangement, $$\frac{1}{\sqrt{|\vec{r_n}-\vec{r_m}|}}$$

is diffusion of a cylindrical wave on the assumption that the virtual sound source is a linear sound source.

The above Equation 1 relates to a sound source rendering theory using wave field synthesis based on the Huygens principle and Kirchhoff-Helmholtz integral. The sound source rendering theory using the wave field synthesis relates to a speaker driving function discriminating a sound source region where a virtual sound source is reproduced and a listening region where n physical loudspeakers radiate sounds through the Ralyleighs representation theorem to obtain a sound radiated by each loudspeaker.

In operation S306, the wave field synthesis renderer 220 performs Fourier transform on a sound pressure signal of an impulse response type, based on Equation 1.

In operation S308, the wave field synthesis renderer 220 performs convolution on each channel sound source signal extracted by the audio signal analyzer 210 and a Fourier-transformed sound pressure signal of an impulse response type to calculate sound source signals, that is, driving signals of respective loudspeakers, which have been rendering-performed using WFS as much as the number of the loudspeakers. The above process can calculate all the driving signals that should be radiated by n loudspeakers to localize one channel sound source signal as a virtual sound source inside the sound source region.

Figure 4:
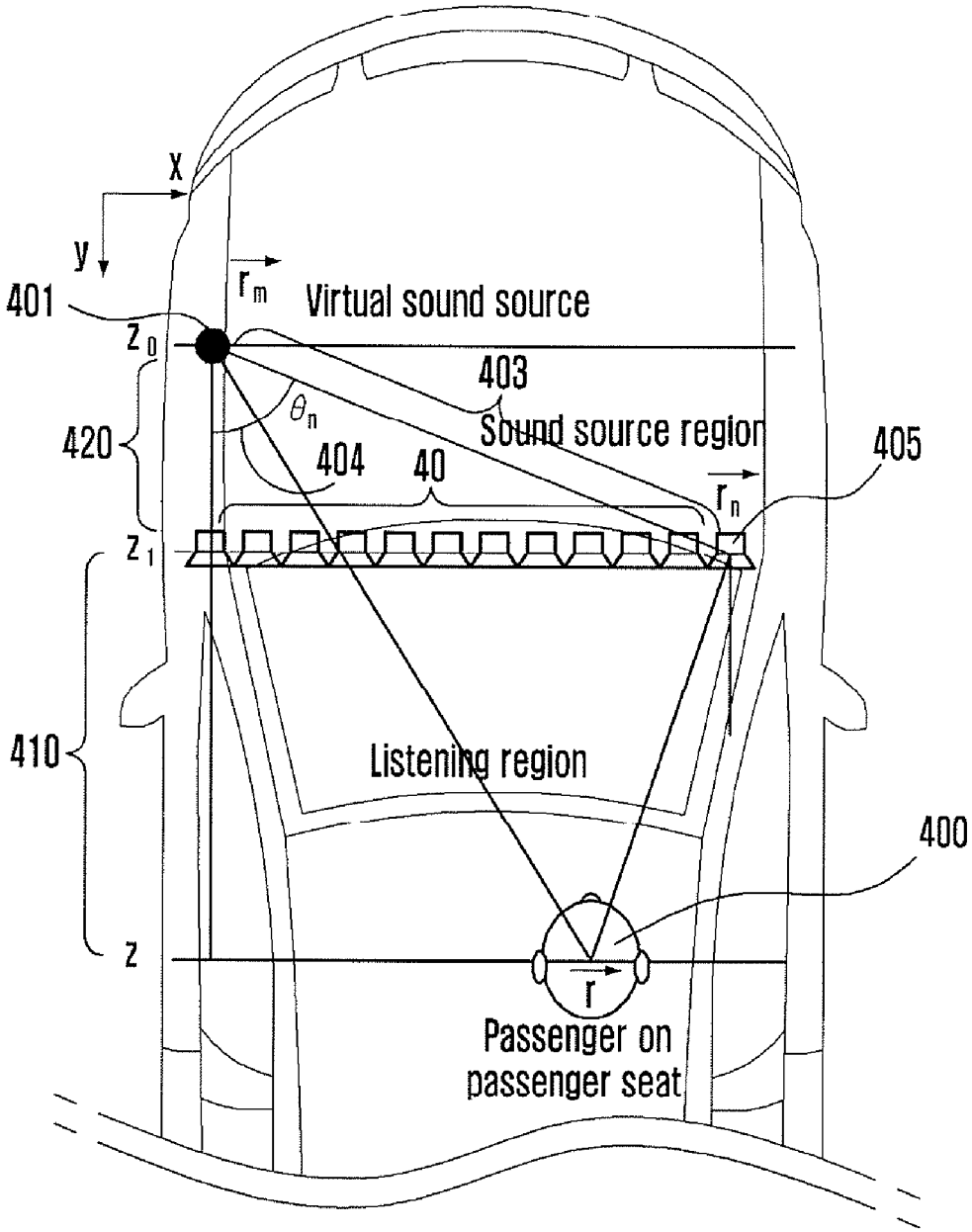
FIG. 4 is a view explaining a virtual sound source virtually localized in the front direction of a passenger.

FIG. 4 is a view explaining a virtual sound source virtually localized in the front direction of a passenger.

Referring to FIG. 4, a vehicle region where a passenger 400 sitting on a passenger seat is divided into a listening region 410 below a loudspeaker array 40 and a sound source region 420 above the loudspeaker array 40. The listening region 410 is a region where a sound can be reproduced through the loudspeaker array 40, and the sound source region 420 is a region where a virtual sound source is localized through the loudspeaker array 40. The surround wave field reproducing apparatus 200 localizes a virtual sound source in the sound source region 420 to provide a wide range of a wave field to the passenger 400 seating on the passenger seat. Here, $r_n$ is a coordinate of an n-th loudspeaker, $r_m$ is a coordinate of a virtual sound source, and $\theta_n$ is an angle between a virtual sound source and the n-th loudspeaker.

When the passenger 400 sitting on the passenger seat intends to reproduce an audio signal as if the loudspeaker array 40 were located at the position 401 of a virtual sound source in the sound source region 420, the wave field synthesis renderer 220 obtains a distance 403 between the n-th loudspeaker and a virtual sound source, and an angle related to the virtual sound source on the basis of the position 401 of the virtual sound source and the position 405 of the n-th loudspeaker. The wave field synthesis renderer 220 applies the obtained distance 403 of the n-th loudspeaker and the virtual sound source, and the angle related to the virtual sound source to Equation 1 to calculate a driving signal of the n-th loudspeaker.

Figure 5:
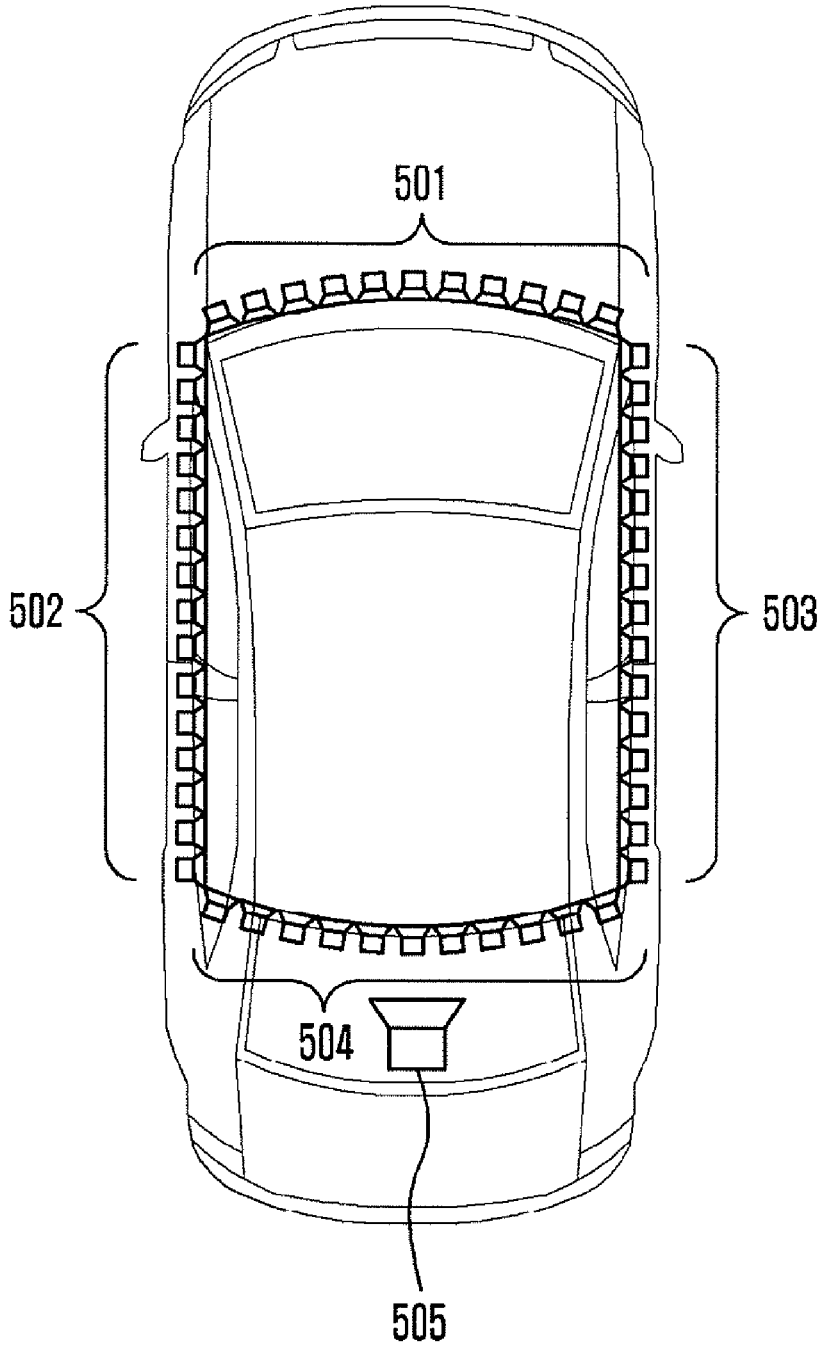
FIGS. 5 and 6 are exemplary views of loudspeaker arrays inside a vehicle in accordance with an embodiment of the present invention.
Figure 6:
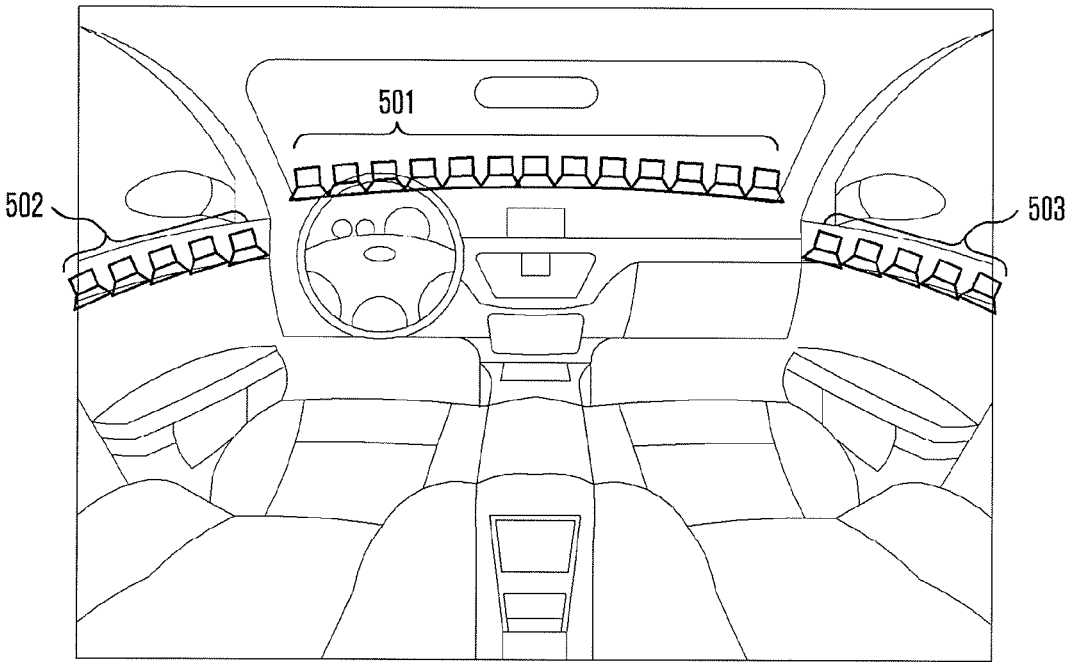

FIGS. 5 and 6 are exemplary views of loudspeaker arrays inside a vehicle in accordance with an embodiment of the present invention.

Referring to FIGS. 5 and 6, the loudspeaker arrays inside the vehicle include a front array 501, a left array 502, a right array 503, a rear array 504, and a sub woofer 505. The loudspeaker array inside the vehicle has a structure of surrounding all inner four sides of the vehicle, and a virtual sound source can be reproduced in any direction of 360° around a listener.

In the case where the loudspeaker arrays cannot be provided to all of the four sides due to the characteristic of a vehicle structure, the loudspeaker arrays inside the vehicle can be realized using the front array 501, the rear array 504, or other combinations. Also, the positions of the left array 502 and the right array 503 can change depending on the inner structure of the vehicle.

Figure 7:
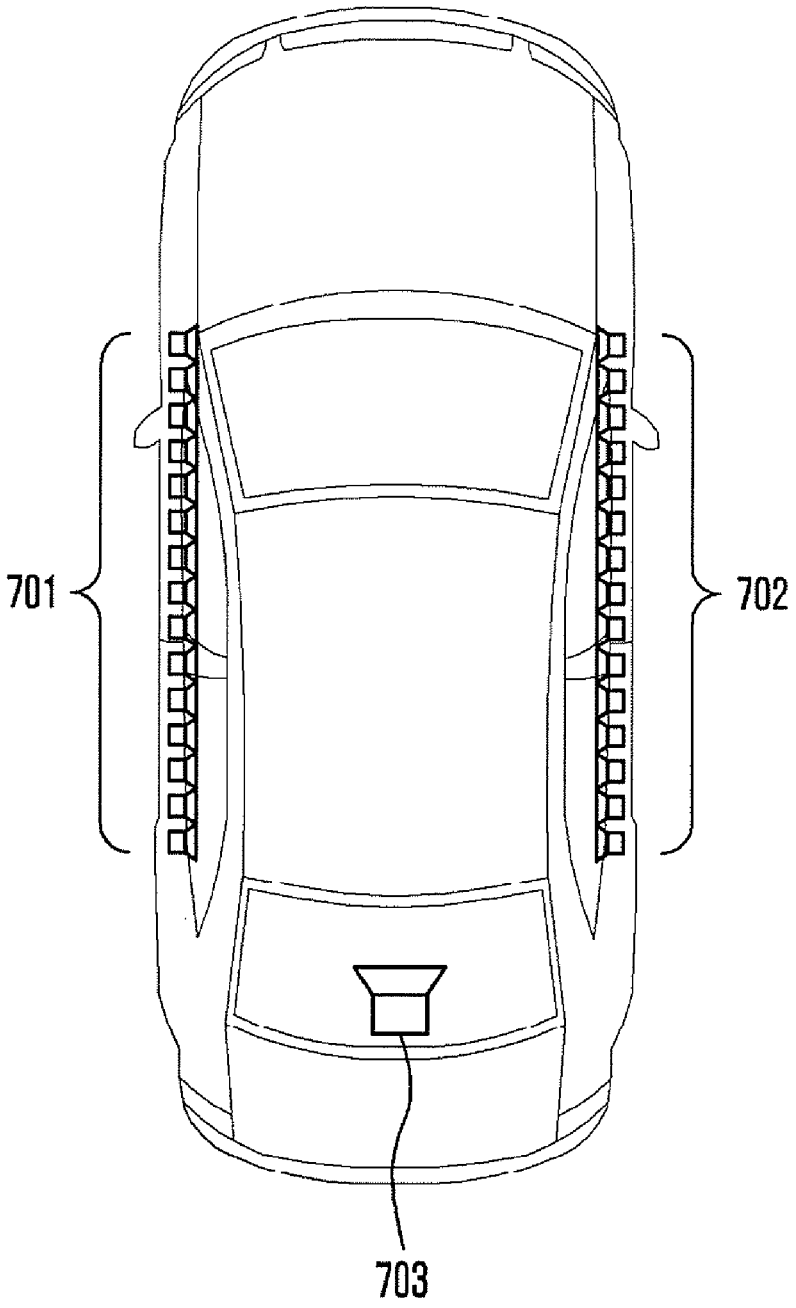
FIGS. 7 and 8 are exemplary views of loudspeaker arrays inside a vehicle in accordance with another embodiment of the present invention.
Figure 8:
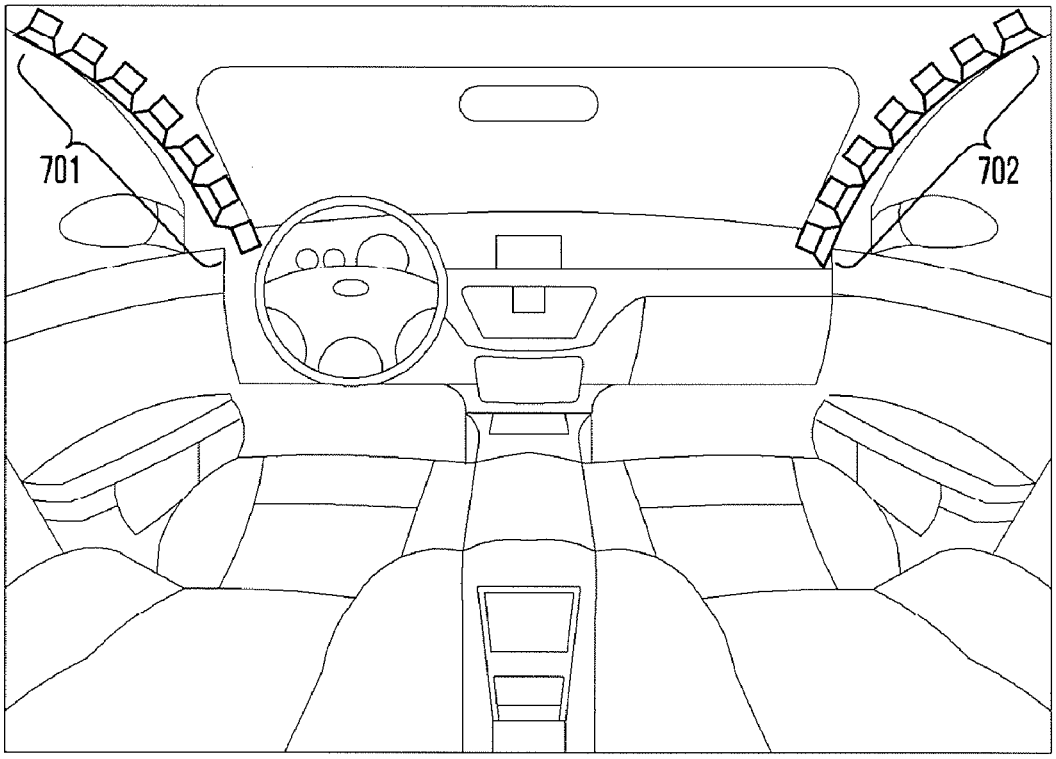

FIGS. 7 and 8 are exemplary views of loudspeaker arrays inside a vehicle in accordance with another embodiment of the present invention.

Referring to FIGS. 7 and 8, the loudspeaker arrays inside the vehicle can be installed to the inner lateral upper frame of the vehicle.

The loudspeaker arrays 701 to 703 illustrated in FIG. 7 are located higher than a listening height compared to the loudspeaker array illustrated in FIG. 5. Therefore, the height may be lowered close to the height of ears of a passenger riding the vehicle.

In the case where the loudspeaker array is installed in a place having a height different from the height of a listener, the wave field synthesis renderer 220 of FIG. 2 can compensate for a difference between ears' height and the height of the loudspeaker array using a head related transfer function (HRTF), expressed as the following Equation 2.

$$S_w = S_o \otimes \frac{HRTF(h_w)}{HRTF(h_o)} \qquad \text{Eq. 2}$$

where $S_w$ is a signal finally corrected to a desired height, $S_o$ is an audio signal to be reproduced, HRTF($h_w$) is a height for correction, that is, HRTF data corresponding to an angle of ears' height corresponding to 0°, and HRTF($h_o$) is a height to be corrected, that is, HRTF data corresponding to an angle value at which the loudspeaker array is physically installed with respect to the ears' height.

As described above, Equation 2 expresses a height correction method using a HRTF. The wave field synthesis renderer 220 removes a physical height component and performs convolution on a height component of the ears' position using Equation 2. Then, the wave field synthesis renderer 220 can finally obtain a signal corrected to a desired height using the HRTF. The above process is intended for allowing a passenger to feel as if the loudspeaker were located at the ears' height.

Figure 9:
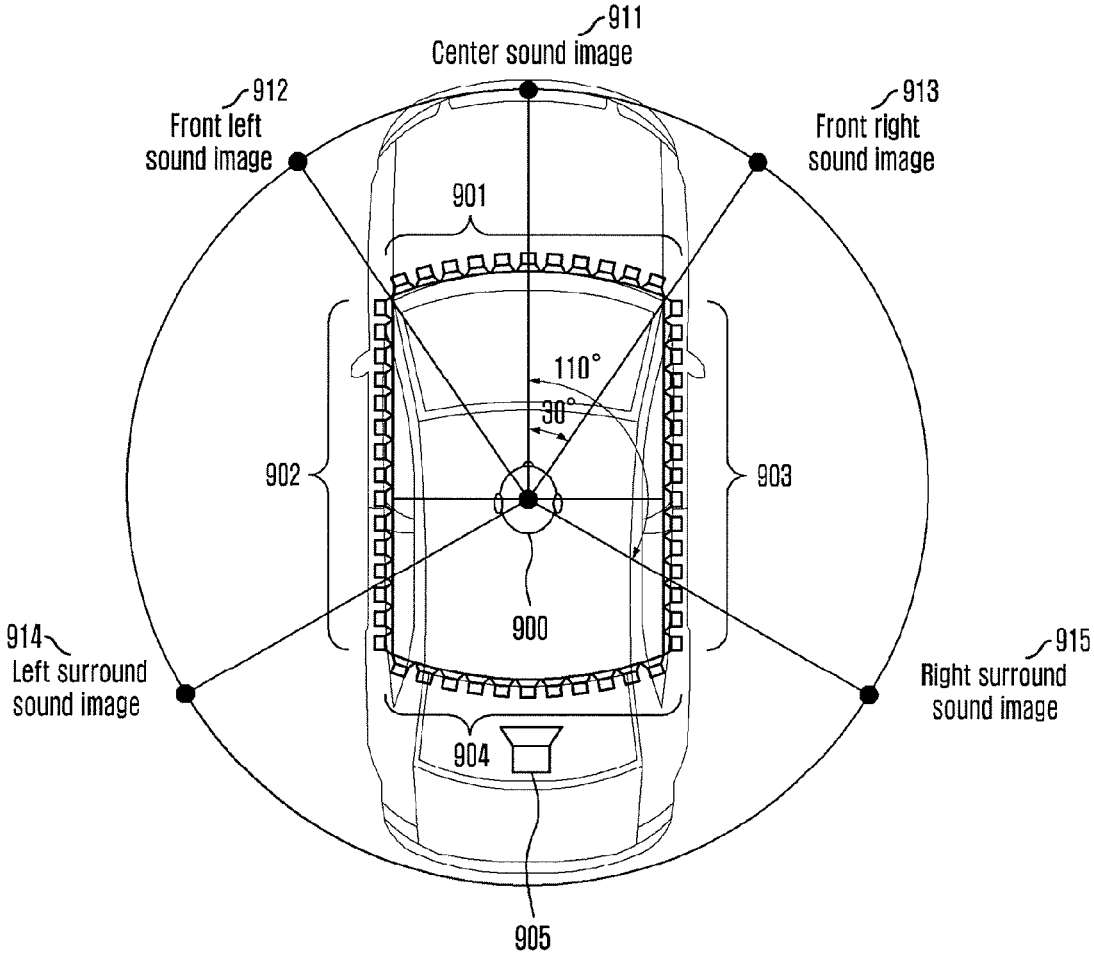
FIG. 9 is a view explaining a method for performing rendering on a multi-channel audio signal using WFS through multi-channel loudspeaker arrays installed inside a vehicle in accordance with an embodiment of the present invention.

FIG. 9 is a view explaining a method for performing rendering on a multi-channel audio signal using WFS through multi-channel loudspeaker arrays installed inside a vehicle in accordance with an embodiment of the present invention.

Referring to FIG. 9, the multi-channel loudspeaker array includes a front array 901, a left array 902, a right array 903, a rear array 904, and a sub woofer 905.

The audio signal analyzer 210 analyzes the sound source format of a received multi-channel audio signal to check the number of audio signal channels, and extracts a channel sound source signal for each checked channel from the received multi-channel audio signal.

To reproduce two-channel audio signals checked by the audio signal analyzer 210, the wave field synthesis renderer 220 localizes the extracted sound source signals of respective channels at a front left sound image position 912 and a front right sound image position 913 of the front direction of a listener, respectively. The wave field synthesis renderer 220 uses the front array 901 and the left array 902 to localize a left channel sound source signal of two-channel audio signals, and uses the front array 901 and the right array 903 to localize a right channel sound source signal.

Meanwhile, to reproduce 5.1-channel audio signals checked by the audio signal analyzer 210, the wave field synthesis renderer 220 localizes the extracted sound source signals of respective channels at five sound image positions 911 to 915 in total of a center sound image position 911 in the front direction of a listener, a front left sound image position 912, a front right sound image position 913, a left surround sound image position 914, and a right surround sound image position 915, respectively. At this point, the wave field synthesis renderer 220 localizes a virtual sound source at a corresponding sound image position using a loudspeaker array corresponding to each channel. For example, the wave field synthesis renderer 220 localizes a left surround channel sound source signal at the left surround sound image position 914 using the rear array 904 and the left array 902, and localizes a right surround channel sound source signal at the right surround sound image position 915 using the rear array 904 and the right array 903.

Here, in case of a 5.1-channel, the positions of corresponding virtual sound sources are located at an angle of 30° and 110° from the reference angle of the front direction set to 0° around the center 900 of the loudspeaker arrays 901 to 904. That is, the angles of both lateral sound images are determined by estimating an angle around the center 900 inside a quadrangle formed by the loudspeaker arrays 901 to 904. At this point, the distance of a sound image can be flexible so that an audio reproduction system inside the vehicle can control the distance. With this construction, the surround wave field reproducing apparatus 200 localizes a virtual sound source at a virtual sound source region distant away from the physical loudspeaker arrays 901 to 904 to allow a passenger to recognize a vehicle listening space as a wider space.

Figure 10:
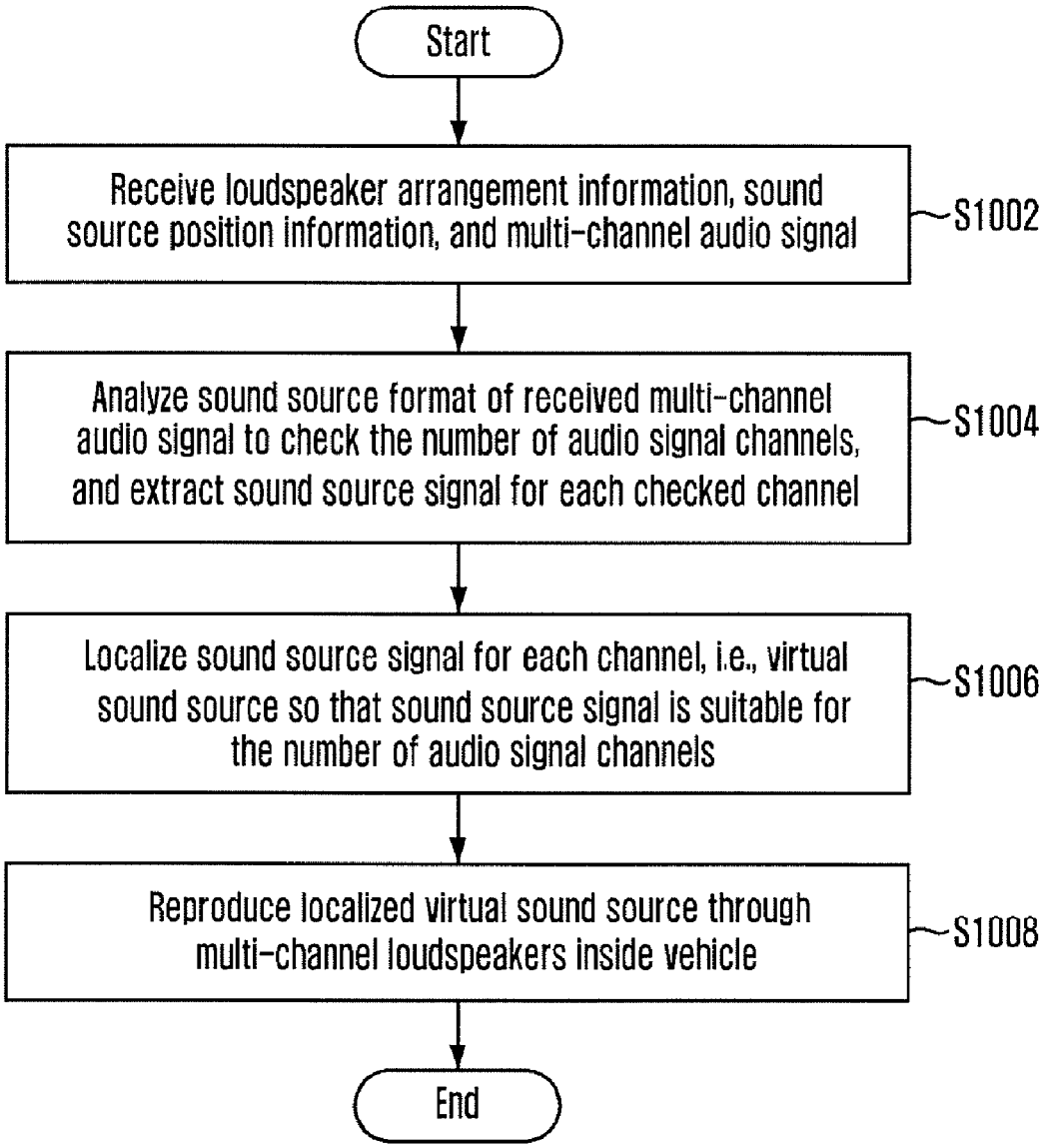
FIG. 10 is a flowchart illustrating a method for reproducing a surround wave field for a vehicle using WFS in accordance with an embodiment of the present invention.

FIG. 10 is a flowchart illustrating a method for reproducing a surround wave field for a vehicle using WFS in accordance with an embodiment of the present invention.

In operation S1002, the audio signal analyzer 210 receives loudspeaker arrangement information, for example, arrangement-related information such as the position and interval of a loudspeaker arrangement, sound source position information, for example, position-related information such as the angle of a virtual sound source with respect to a listening position, and a multi-channel audio signal, that is, a sound source signal to be localized.

In operation S1004, the audio signal analyzer 210 analyzes the sound source format of a received multi-channel audio signal to check the number of audio signal channels, and extracts a channel sound source signal for each checked audio signal channel from the received multi-channel audio signal.

The wave field synthesis renderer 220 performs rendering on a multi-channel audio signal using WFS so that the signal is suitable for the number of the audio signal channels checked by the audio signal analyzer 210. That is, the wave field synthesis renderer 220 localizes each extracted channel sound source signal, that is, a virtual sound source so that the virtual sound source is suitable for the number of the checked audio signal channels.

In operation S1008, the reproducer 130 reproduces the virtual sound source on which rendering has been performed by the wave field synthesis renderer 220 through the multi-channel loudspeaker inside the vehicle.

The present invention has an effect that can provide a constant sound image to a user regardless of a position, for example, a vehicle riding position, and provide a wide listening space even in a limited space by localizing multi-channel audio signals at a virtual sound image outside a narrow space to reproduce surround wave field using particularly wave field synthesis (WFS) rendering, when reproducing the multi-channel audio signals through a loudspeaker array installed in the narrow space, for example, a vehicle space.

That is, the present invention has an effect that can provide a more accurate and stable sound image to a user and allow the user to feel as if he or she were positioned in a wider space such as a living room of a house or a concert hall, not a narrow space inside of a vehicle by reproducing surround wave field using wave field synthesis (WFS) through a multi-channel loudspeaker array, when reproducing audio signals inside a vehicle, so that the user can comfortably appreciate an audio.

Also, the present invention has an effect that can localize a constant virtual sound image at any position regardless of the position of a listener by reproducing a plane wave field using WFS through a loudspeaker array. At this point, since a listener feels as if a sound were heard from an outside of a position at which the loudspeaker physically exists, the listener feels a wider listening space.

The methods for reproducing a surround wave field using wave field synthesis in accordance with the embodiments of the present invention can be realized as a computer program. Also, codes, and code segments for accomplishing the present invention can be easily construed by programmers skilled in the art to which the present invention pertains. Also, the computer program is stored in a computer-readable recording medium or information storing medium and read and executed by a computer to realize the method in accordance with the present invention. Examples of the recording medium include all types of computer-readable recording media.

While the present invention has been described with respect to the specific embodiments, it will be apparent to those skilled in the art that various changes and modifications may be made without departing from the spirit and scope of the invention as defined in the following claims.

What is claimed is:

1. An apparatus for reproducing a surround wave field for a loudspeaker array confined to a narrow space, the apparatus comprising:

an audio signal analyzer that analyzes a received multi-channel audio signal to check the number of audio signal channels, and extracts a sound source signal for each checked channel from the multi-channel audio signal;

a wave field synthesis renderer that receives loudspeaker arrangement information about the loudspeaker array and localizes the extracted sound source signal for each channel at a virtual sound image outside the narrow space using wave field synthesis, based upon the number of the checked audio signal channels, and wherein the wave field synthesis renderer localizes the extracted sound source signal by:

obtaining, from the loudspeaker arrangement information, a distance and an angle between each loudspeaker in the loudspeaker array and a sound source position, applying the obtained distance and angle between each loudspeaker and the sound source position to a loudspeaker driving function to obtain a sound pressure signal of an impulse response type, performing Fourier transform on the obtained sound pressure signal of the impulse response type, and performing convolution on the extracted sound source signal for each channel and the Fourier-transformed sound pressure signal of the impulse response type to calculate a driving signal of each loudspeaker; and an audio reproducer that reproduces the localized virtual sound source signal.

2. The apparatus of claim 1, wherein the audio signal analyzer extracts sound source signals different from each other for respective channels depending on the number of the checked audio signal channels.

3. The apparatus of claim 1, wherein the wave field synthesis renderer corrects a height difference between an installation height of the loudspeaker array and a user's ear height using a head related transfer function (HRTF).

4. The apparatus of claim 3, wherein the wave field synthesis renderer calculates an angle of a virtual sound source to be localized using a central position of a loudspeaker as a reference.

5. The apparatus of claim 3, wherein the wave field synthesis renderer localizes sound source signals at a front left and a front right, respectively, when the multi-channel audio signal is a two-channel audio signal on the basis of audio signal channel information checked by the audio signal analyzer.

6. The apparatus of claim 3, wherein the wave field synthesis renderer localizes sound source signals at a center, a front left, a front right, a rear left, and a rear right, respectively, when the multi-channel audio signal is a 5.1-channel audio signal on the basis of audio signal channel information checked by the audio signal analyzer.

7. A method for reproducing a surround wave field, the method comprising:

analyzing a received multi-channel audio signal to check the number of audio signal channels;

extracting a sound source signal for each checked channel from the multi-channel audio signal;

receiving loudspeaker arrangement information for a loudspeaker array within a narrow space;

receiving sound source position information;

localizing the extracted sound source signal for each channel at a virtual sound image outside the narrow space using wave field synthesis so that the extracted sound source signal is suitable for the number of the checked audio signal channels, and wherein said localizing includes:

obtaining, from the loudspeaker arrangement information, a distance and an angle between each loudspeaker of the loudspeaker array and a sound source position;

applying the obtained distance and angle between each loudspeaker and the sound source position to a loudspeaker driving function to obtain a sound pressure signal of an impulse response type;

performing Fourier transform on the obtained sound pressure signal of the impulse response type; and performing convolution on the extracted sound source signal for each channel and the Fourier-transformed sound pressure signal of the impulse response type to calculate a driving signal of each loudspeaker; and reproducing the localized virtual sound source signal.

8. The method of claim 7, wherein sound source signals different from each other for respective channels depending on the number of the checked audio signal channels are extracted.

9. The method of claim 7, wherein a height difference between an installation height of the loudspeaker array and a user's ear height is corrected using a head related transfer function (HRTF).

10. The method of claim 9, wherein an angle of a virtual sound source to be localized is calculated using a central position of a loudspeaker as a reference.

11. The method of claim 9, wherein sound source signals at a front left and a front right, respectively, are localized when the multi-channel audio signal is a two-channel audio signal on the basis of audio signal channel information checked in said analyzing of the received multi-channel audio signal.

12. The method of claim 9, wherein sound source signals at a center, a front left, a front right, a rear left, and a rear right, respectively, is localized when the multi-channel audio signal is a 5.1-channel audio signal on the basis of audio signal channel information checked in said analyzing of the received multi-channel audio signal.

13. An apparatus for reproducing a surround wave field, the apparatus comprising:

at least two linear arrays of loudspeakers in a vehicle, each linear array having at least three loudspeakers;

an audio signal analyzer that analyzes a received multi-channel audio signal, determines a number of audio signal channels comprising the multi-channel audio signal, and extracts a sound source signal for each audio signal channel; and a wave field synthesis renderer that receives loudspeaker arrangement information about the at least two loudspeaker linear arrays in the vehicle, and localizes the extracted sound source signal for each audio signal channel at a virtual sound image outside the vehicle using wave field synthesis, wherein the at least two linear arrays of loudspeakers reproduce the audio signal at the virtual sound image.

* * * * *